US006060097A

United States Patent [19]

Grigoryan

[11] Patent Number: 6,060,097

[45] Date of Patent: May 9, 2000

[54] FOOD CUP

[76] Inventor: Vardan Grigoryan, 521 E. Valencia Ave. #B, Burbank, Calif. 91501

[21] Appl. No.: 08/932,296

[22] Filed: Sep. 17, 1997

Related U.S. Application Data

[63] Continuation of application No. 08/628,086, Apr. 8, 1996, abandoned.

[51] Int. Cl.[7] ..... B65D 83/00; B65D 85/00

[52] U.S. Cl. ..... 426/112; 426/115

[58] Field of Search ..... 426/112, 115

[56] References Cited

U.S. PATENT DOCUMENTS

| | | | |
|---|---|---|---|
| 2,980,540 | 4/1961 | Turpin | 426/112 |
| 4,444,324 | 4/1984 | Grenell | 426/115 X |

*Primary Examiner*—Leo B. Tentoni

[57] ABSTRACT

A Food Cup made from cardboard from which the food such as sunflower and pumpkin seeds, pop-corn, chips, Cheerios, French-fried potatoes, stewed rice, etc., is taken out through a mouth that opens in the lower part of the container and the food waste is placed into a waste cup which is placed on the food and which goes down synchronous to diminution of food.

16 Claims, 3 Drawing Sheets

D. $\frac{1}{12}$D. $\frac{1}{2}$D. $\frac{2}{3}$D. $1\frac{1}{2}$D.

FOOD CUP

This application is a continuation of application Ser. No. 08/628,086, filed Apr. 8, 1996, now abandoned.

BACKGROUND OF THE INVENTION

The present invention relates to packaging and serving various types of food (sunflower, pumpkin seed, pop-corn, chips, Cheerios, candies, French-fried potatoes, stewed rice, etc.), also including beverages, spices, and appetizers used with food.

The present invention is intended for use during traveling, when having picnics, in auditoriums, in theaters and movies, or in the family circle, and will make eating a more pleasurable and clean procedure.

DESCRIPTION OF THE PRIOR ART

All of the present-day forms of packaging of the above mentioned kinds of food have an apt choice of materials and beautiful design. However, all of them display inconvenience when actually eating the food, making the eating process messy and not a pleasurable activity, especially when the food is accompanied with beverages and appetizers. The inconvenience is more clearly seen when there is no table around.

SUMMARY OF THE INVENTION

It is an object of the invention to make the eating process more pleasurable and convenient while keeping the utmost cleanliness. The advantages of the invention will be more clearly seen during walking, traveling, as well as among the spectators and handicapped. The invention can also be used for feeding of birds and certain types of animals.

A further object of the invention is to restore quickly and easily the original packaging condition of the food when the food is eaten with interruptions in order to keep the food clean and not scattered.

BRIEF DESCRIPTION OF THE DRAWINGS

The present invention will be more fully understood by reference to the following detailed description thereof when read in conjunction with the attached drawings, and wherein.

DETAILED DESCRIPTION OF THE INVENTION

Figure 1:
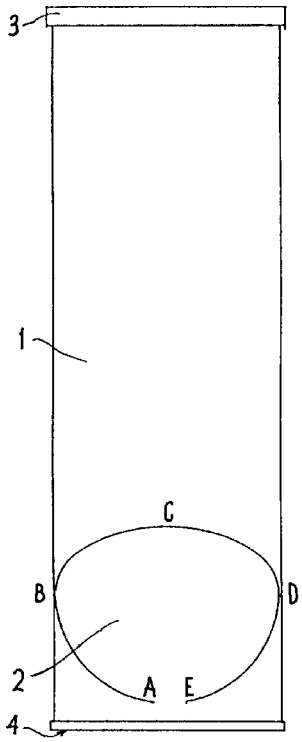
FIG. 1. is a front elevational view of the Food Cup with the mouth closed.
Figure 2:
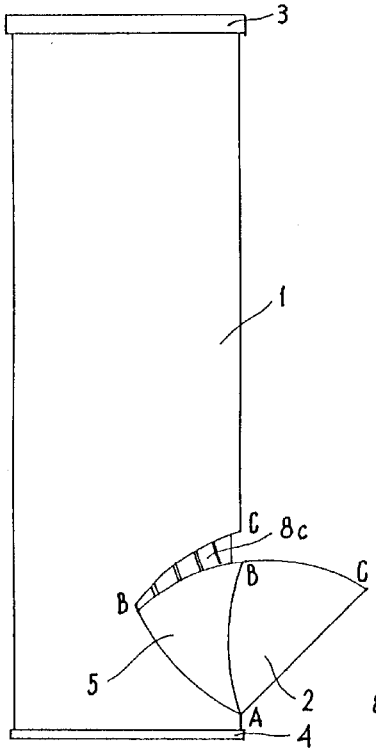
FIG. 2. is a side elevational view thereof with the mouth open.
Figure 3:
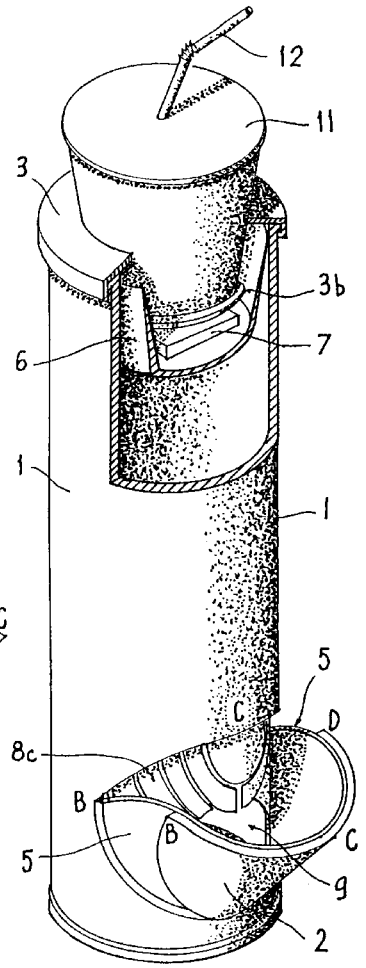
FIG. 3. is a perspective sectional view thereof with the beverage cup fit into the semi-complex cover, the napkin put into the waste cup, and the mouth open.
Figure 4:
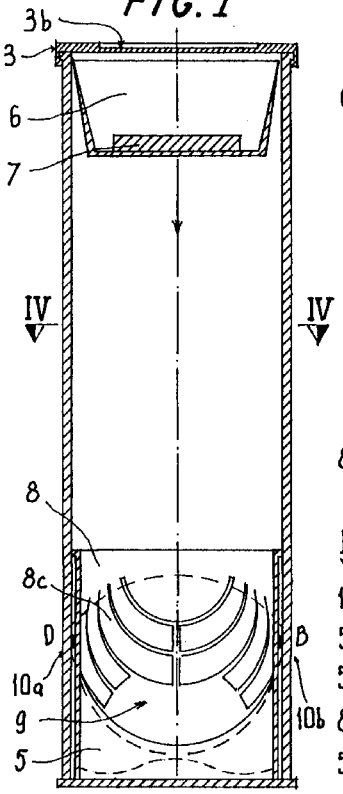
FIG. 4. is a sectional view of the Food Cup depicted in FIG. 1.
Figure 5:
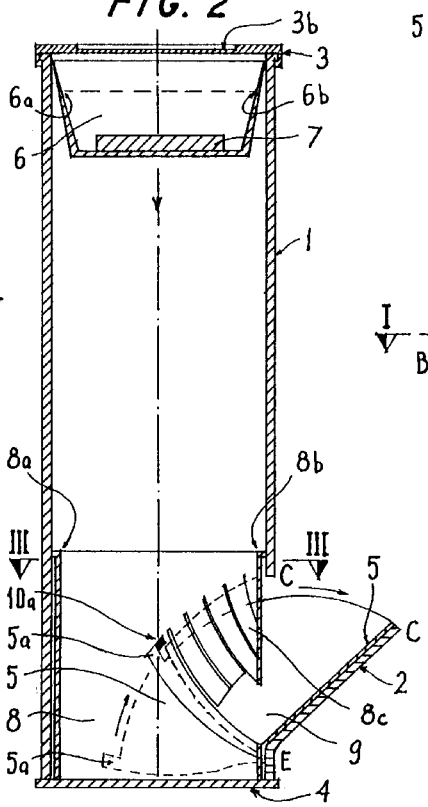
FIG. 5. is a sectional view of the Food Cup depicted in FIG. 2.
Figure 6:
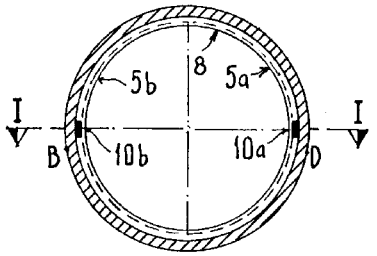
FIG. 6. is a sectional view of the Food Cup in FIG. 4 along plane IV—IV.
Figure 7:
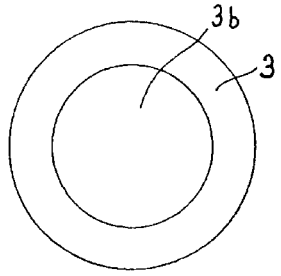
FIG. 7. is a top view of the Food Cup.
Figure 8:
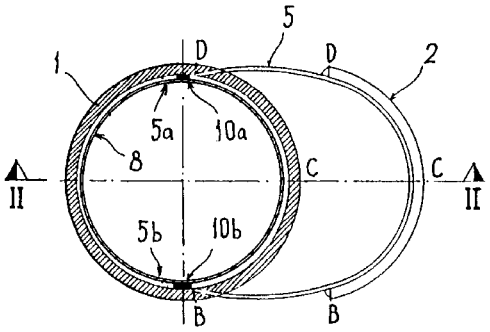
FIG. 8. is a top sectional view of the Food Cup in FIG. 4 along plane III—III.
Figure 9:
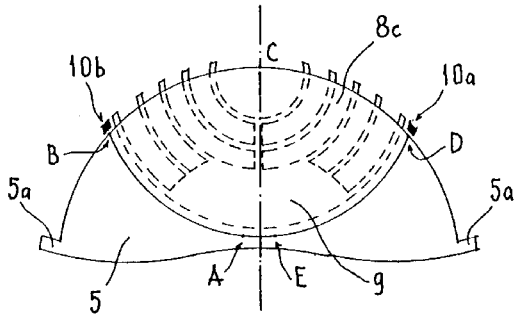
FIG. 9. is an unfolded view of the mouth, auxiliary semicircle, and the teeth of the inner cylinder.
Figure 10:
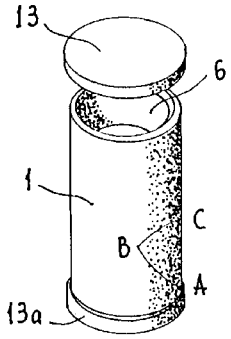
FIG. 10. is a perspective view of the simple cover placed on top of the outer cylinder.
Figure 11:
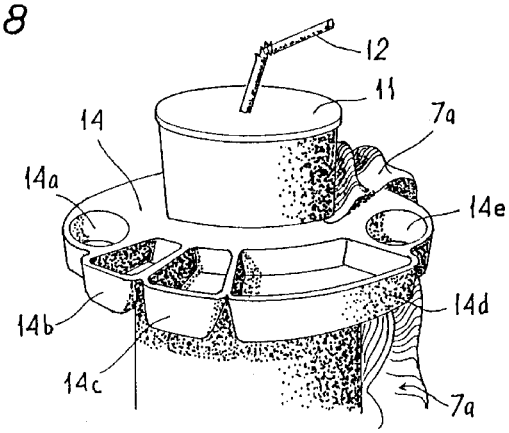
FIG. 11. is a perspective view of the complex cover, beverage cup, and a napkin set between them.
Figure 12:
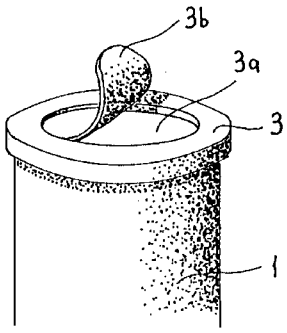
FIG. 12. is a perspective view of the semi-complex cover.
Figure 13:
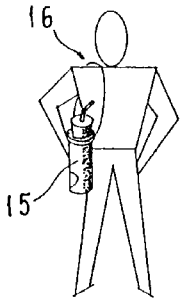
FIG. 13. depicts the Food Cup with semi-complex cover hanging over a person's shoulder.
Figure 14:
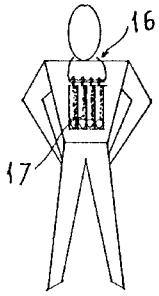
FIG. 14. depicts several stranded small Food Cups hanging over a person's neck.
Figure 15:
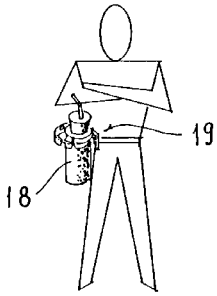
FIG. 15. depicts the Food Cup with the complex cover attached to a person's belt.
Figure 16:
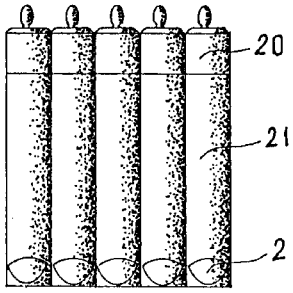
FIG. 16. is a perspective view of joint Food Cups for the kitchen.
Figure 17:
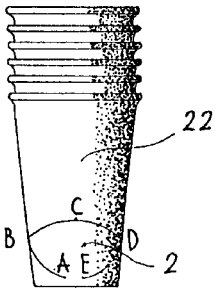
FIG. 17. is a perspective view of the Food Cup in a tapered form.
Figure 18:
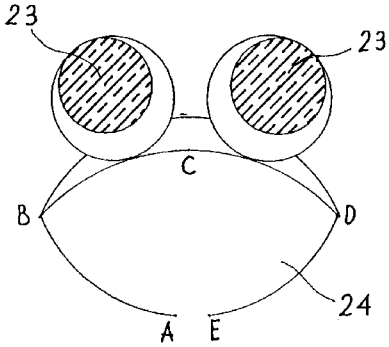
FIG. 18. depicts the Food Cup in which the mouth is in a frog mouth shape.
Figure 19:
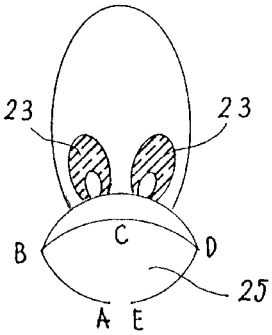
FIG. 19. depicts the Food Cup in which the mouth is in a duck mouth shape.
Figure 20:
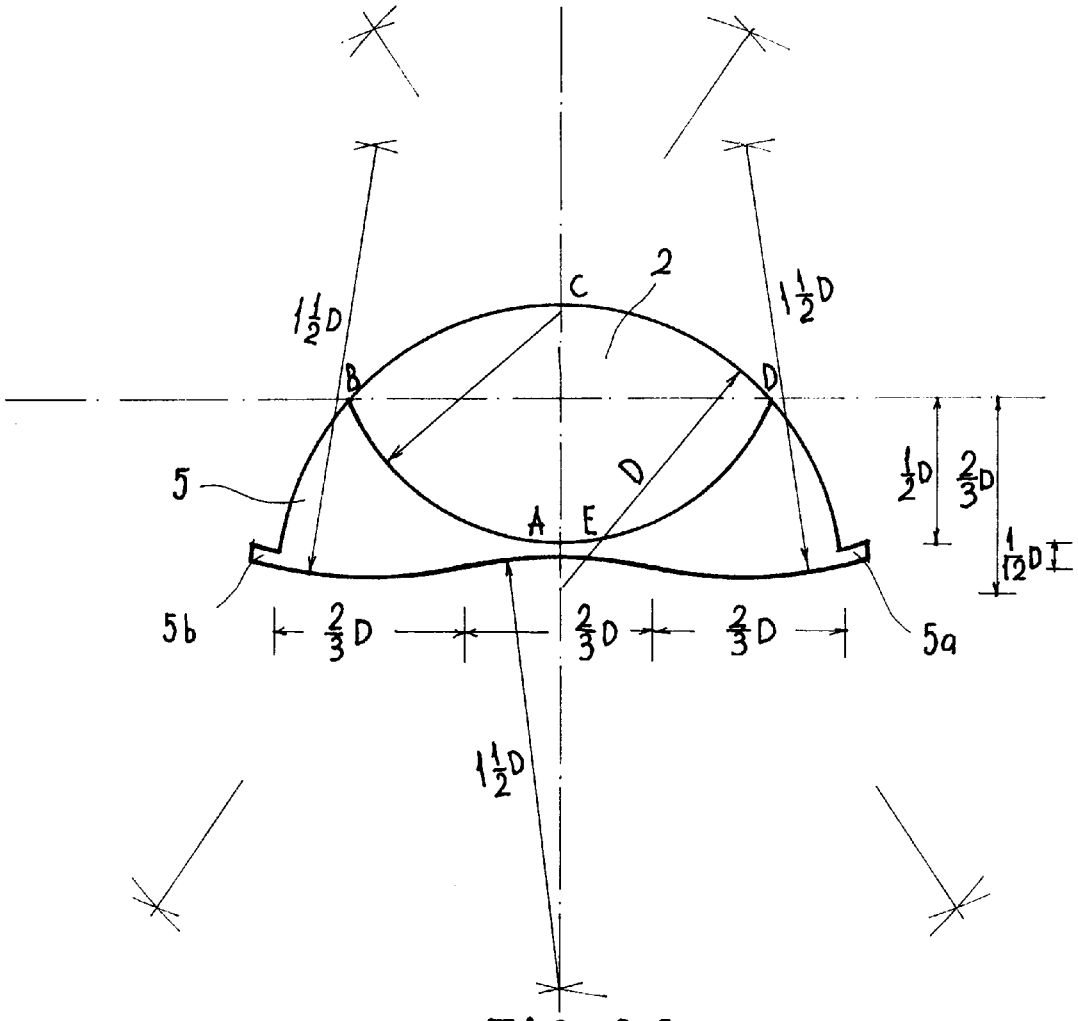
FIG. 20. is a view of the proportions of the Food Cup mouth and the auxiliary semicircle relative to the diameter of the cylinder.

The Food Cup has an outer 1 and an inner 8 cylinders. The base 4 of the outer cylinder 1 is closed whereas the top part has three—simple 13, semicomplex 3, or complex 14—types of removable covers. The inner cylinder 8 is open at both ends and is placed inside the lower part of the outer cylinder 1.

In the lower part of the outer cylinder 1 opens an ABCDE mouth 2 which at AE remains unseparated from the outer cylinder 1. On the inside of the outer cylinder 1, to the mouth 2 adheres an auxiliary semicircle 5, which moves between the outer 1 and the inner 8 cylinders during the mouth 2 opening and closing, so that the remaining food in the inner cylinder 8 won't prevent the mouth 2, from opening or closing. Close to the points B and D of the two angles of the mouth 2, the outer 1 and the inner 8 cylinders are in contact with each other by the two blocking dots 10*a* and 10*b*; when the mouth 2 is opening, two prongs 5*a* and 5*b* of the auxiliary semicircle 5 reach the blocking dots 10*a* and 10*b*, which stops the mouth 2 in the open position for eating the food therein. Inside the mouth 2, the inner cylinder 8 has teeth 8*c* which limit food flow coming from the hollow 9 thus playing a regulating role, and since the teeth 8*c* partially bend inwards, they do not prevent the unfinished food from going back inside during closing of the mouth 2. Choosing the size of the hollow 9 depends on the size and type of food. When opening the mouth 2, the thumb of the right hand is placed on point B, and the middle finger on point D, then these two fingers draw the mouth 2 a little outside; then the index finger from point C opens the mouth 2 completely; and when closing, the mouth is simply pushed to its original position.

In the upper part of the outer cylinder 1, on top of the food, is placed the waste cup 6 to hold the food waste, which goes down synchronous to diminution of food thus yielding a place for the food waste, and which also serves as a shield preventing the food from mixing with the food waste. When the waste cup 6 is going down, its circumference 6*a*–6*b* meets the upper circumference of the inner cylinder 8, stopping above the hollow 9 thus letting the last portions of food be taken out easily. The lip 8*a*–8*b* of the upper circumference of the inner cylinder 8 is in contact with the inside of the outer cylinder 1.

The covers for the Food Cup—simple 13, semi-complex 3, complex 14—are chosen according to the types of food.

(a): In case of sunflower, pumpkin, and other seed, the simple cover is chosen which doesn't perform any function. The simple cover 13 is taken off and attached underneath the outer cylinder 13*a* thus opening a space for filling the waste shells into the waste cup 6;

(b): In case of chips, pop-corn, candies, Cheerios and the like, the semicomplex cover 3 is chosen, in the central round opening 3*a* of which a beverage cup 11 with a straw 12 is placed.

(c): In case of French-fried potatoes, stewed rice, etc., the complex 14 cover is used, on which several various compartments 14*a*, 14*b*, 14*c*, 14*d*, 14*e*, are made for holding spices and appetizers, and the central round opening 3*a* for holding the beverage cup 11. The complex 14 cover turns around the cylinder's central axis so that the eater can adjust it according to his or her preferences.

In case of using the semi-complex 3 cover, the membrane 3*b* of the round opening 3*a* is separated from the cover 3, the napkin 7 is removed from the waste cup 6, is unfolded and is placed between the round opening 3*a* and the beverage cup 11, and is used during eating 7*a*.

The same procedure is performed when using the complex 14 cover.

A Food Cup with the semi-complex cover 15, hangs by a rope 16 over a person's shoulder; stranded 17 small Food Cups hang over a person's neck, and the Food Cup with the complex cover 18 by a fastener 19 is attached to the belt.

Joint 21 Food Cups are used in the kitchen, and their upper parts serve for placing cylindrical cups 20 for holding ground pepper, salt, sugar, coffee, etc.

When the food is served in a service station, the outer 1 cylinder is replaced by a cut cone 22, for saving space, since the Food Cups in cut-cone form can be put into one another. The Food Cup in this case does not have the waste cup 6.

The mouth 2 of the Food Cup, made in a form of a frog 24 or a duck 25 mouth, has the animal eye holes 23 cut out from the outer cylinder 1 and covered by the inner cylinder 8, which in this case is made from the transparent material so that the type of food put inside the Food Cup is visible through the animal eye holes 23.

Food Cups are made disposable or reusable.

The Food Cups are useful for handicapped persons since when the Food Cup is being hung from the neck, only one hand is required for using it.

When feeding pets, the base 4 of the Food Cup is adhered by a double-sided tape to the floor, and when feeding birds or other animals kept in cages, the Food Cup is attached outside the cage, and only the mouth 2 of the Food Cup opens inside.

It will of course be understood that various changes may be made in the form, detail, arrangement and proportion of the various parts of this invention without departing from the scope of the invention which consists of the matter described herein and set forth in the appended claims. It is also understood that the shape of the Food Cup can be cylindrical, conical, square, rectangular or any other similar shape which are encompassed by the invention.

What I claim as my invention is:

1. A food container comprising an outer cylinder and an inner cylinder, said outer cylinder having a closed base end and a top end closed with a removable top cover, said inner cylinder being open at both ends and located in the lower part of said outer cylinder at said base end, the insides of said outer cylinder being adjacent to the outsides of said inner cylinder, the lower part of said outer cylinder and said inner cylinder having openings of the same size and shape adjacent to each other, a movable cup of the same size and shape as said openings positioned to open and close said openings simultaneously, the top portion of the opening of said inner cylinder having a plurality of movable teeth to permit food in said movable cup to reenter said inner cylinder when said movable cup is closed to cover said openings, said movable cup being hinged and having sides which move into the space between the inner portion of said outer cylinder and the outer portion of said inner cylinder when said movable cup is in a closed position and form a cup open at the top to contain said food when said movable cup is in the open position.

2. The food container of claim 1 wherein the bottom portion of said movable cup is cut out from said outer cylinder thereby creating said opening, but leaving uncut only a portion at the bottom to act as a hinge for said movable cup.

3. The food container of claim 1 wherein said movable cup has means to prevent it from opening beyond the length of the sides of said movable cup so as to prevent spilling the food out of the said movable cup.

4. The food container of claim 1 containing a downwardly movable tapered waste cup located inside said outer and inner cylinders for storage of waste portions of food, only the top of said waste cup being large enough to engage the top edge of said inner cylinder in the lowest position of said waste cup.

5. A food container comprising an outer cylinder and an inner cylinder, said outer cylinder having a closed base end and a top end closed with a removable top cover, said inner cylinder being open at both ends and located in the lower part of said outer cylinder at said base end, the diameter of said inner cylinder being less than the diameter of said outer cylinder, the lower part of said outer cylinder and said inner cylinder having openings of the same size and shape adjacent to each other, a movable cup of the same size and shape as said openings positioned to open and close said openings simultaneously, the top portion of the opening in said inner cylinder having a plurality of movable teeth to permit food in said movable cup to reenter said inner cylinder when said movable cup is closed to cover said openings, said movable cup being hinged at the bottom and having sides which move into the space between the inner diameter of said outer cylinder and the outer diameter of said inner cylinder when said movable cup is in a closed position and form a cup open at the top to contain said food when said movable cup is in the open position.

6. The food container of claim 5 wherein the bottom portion of said movable cup is cut out from said outer cylinder thereby creating said opening, but leaving uncut only a small portion at the bottom to act as a hinge for said movable cup.

7. The food container of claim 5 wherein said movable cup has means to prevent it from opening beyond the length of said sides of said movable cup so as to prevent spilling the food out of the cup portion of said movable cup.

8. The food container of claim 5 containing a downwardly movable waste cup having a tapered shape for storage of waste portions of food located inside said outer and inner cylinders with an outside diameter smaller than the inside diameter of said inner cylinder at the bottom of said movable waste cup and the outer diameter of the top of said waste cup being equal to the outer diameter of the inner cylinder.

9. The food container of claims 1 or 5 wherein the removable top cover contains a flexible center portion which is peeled back to open the food container at the top for filling with food, food waste or inserting a drink cup.

10. The food container of claims 1 or 5 wherein the removable top cover is rotatable about a central axis of said outer cylinder and contains protruding shelves around its circumference for holding food.

11. The food container of claims 1 or 5 wherein said inner and outer cylinders are tapered in shape.

12. The food container of claims 1 or 5 wherein said means to prevent the movable cup from opening beyond the length of the sides of said movable cup are protruding dots fastened to both the outer and inner cylinders, and the end portions of the sides of said movable cup being shaped like prongs so as to engage said protruding dots when said movable cup is in the open position.

13. A food container for combining eating, drinking, and collecting the food waste into an outer cylinder with a closed base end and an open top end closed with a removable cover, an inner cylinder open on two ends located inside the outer cylinder at the bottom thereof, the dry small-particulate ready-to-eat food in the said outer cylinder being taken from an opening at the bottom of the said outer cylinder and the said inner cylinder, the said opening containing a movable cup opening downwards towards the outside on the lower side of the said outer cylinder, said movable cup being hinged at the bottom and having sides which move into the space between the inner cylinder and the outer cylinder when said movable cup is in a closed position and form a cup open at the top to contain said food when said movable cup is in the open position, the said inner cylinder having movable teeth above said opening in the inner and outer cylinders, and the food waste being put into a waste cup placed inside the said outer cylinder on top of the food, the said waste cup being filled through the said central round opening of the said removable cover.

14. The food container of claim 13, wherein the said movable cup is a semicircle with prongs on each end thereof which slides between the said outer cylinder and the said inner cylinder during opening and closing of the said mouth, and while opening the mouth, the two prongs of the said movable cup reaching two blocking dots connecting the said outer and the said inner cylinders together at the corners of the said opening which stop the movement of the said movable cup, leaving an optimal space inside the said movable cup for convenient manipulation of the food, the overflow being blocked by the said teeth of the said inner cylinder so that the food flows through the said hollow into the base of the opened movable cup in the same quantity that is taken out of the said movable cup to be consumed, and while closing the said movable cup the remaining food in the base therein slightly bends the teeth edges inwards thus permitting the said movable cup to be closed easily and completely.

15. The food container of claim 13, wherein the said removable cover placed on the said open top end of the said outer cylinder is initially closed with a membrane, the said membrane then being separated and put into the said waste cup in the said outer cylinder through the said central round opening, the said central round opening intended for placing a cup with a drink to be used while eating the food.

16. The food container of claim 13, wherein the said waste cup is placed on top of the dry small-particulate ready-to-eat food inside the outer cylinder, the waste cup going down following the diminishing of the food underneath and being a barrier between the food and the food waste, until the outer diameter of the upper portion of said waste cup when sliding through the inner surface of the outer cylinder, rests on the upper portion of the open top end of the said inner cylinder, the base of the said waste cup stopping above the said hollow of the said mouth thus leaving the said hollow open for the last portions of the food to flow into the opened said mouth.

* * * * *